United States Patent [19]

Katabe et al.

[11] 4,250,047

[45] Feb. 10, 1981

[54] LUBRICANT COMPOSITIONS FOR SYNTHETIC FIBERS AND METHOD FOR LUBRICATING SYNTHETIC FIBERS

[75] Inventors: Kenichi Katabe; Takeshi Hirota; Osamu Wakasugi, all of Wakayama, Japan

[73] Assignee: Kao Soap Co., Ltd., Tokyo, Japan

[21] Appl. No.: 41,924

[22] Filed: May 24, 1979

[30] Foreign Application Priority Data

May 30, 1978 [JP] Japan ..... 53-64536

[51] Int. Cl.[3] ..... C10M 1/06

[52] U.S. Cl. ..... 252/49.5; 8/115.6; 252/8.6; 252/8.9; 252/52 M; 252/56 R; 252/56 S

[58] Field of Search ..... 252/49.5, 52 A, 56 R, 252/56 S, 8.6, 8.9; 8/115.6

[56] References Cited

U.S. PATENT DOCUMENTS

| | | | |
|---|---|---|---|
| 2,298,432 | 10/1942 | Thompson | 252/49.5 X |
| 2,730,498 | 1/1956 | Fortess et al. | 252/49.5 X |
| 2,834,731 | 5/1958 | Carpenter | 252/49.5 X |
| 3,282,843 | 11/1966 | Alburger | 252/49.5 X |
| 3,850,682 | 11/1974 | Sturwold et al. | 252/56 S X |
| 4,127,490 | 11/1978 | Newkirk et al. | 252/52 A X |
| 4,144,178 | 3/1979 | Katabe et al. | 252/8.6 X |

FOREIGN PATENT DOCUMENTS

| | | | |
|---|---|---|---|
| 904830 | 7/1972 | Canada | 252/56 S |
| 2702460 | 7/1977 | Fed. Rep. of Germany | 252/52 A |
| 1189477 | 7/1970 | United Kingdom | 252/49.5 |

*Primary Examiner*—Andrew Metz

*Attorney, Agent, or Firm*—Blanchard, Flynn, Thiel, Boutell & Tanis

[57] ABSTRACT

Synthetic fibers are treated for the purpose of lubrication with a compound of the formula:

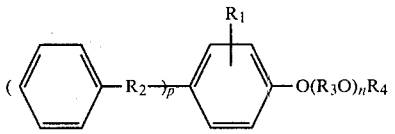

[I]

wherein $R_1$ is hydrogen or phenyl, $R_2$ is an alkylene group having 1 to 3 carbon atoms, $R_3$ is an alkylene group having 2 to 4 carbon atoms or a mixed alkylene group thereof, $R_4$ is hydrogen, an acyl having 1 to 18 carbon atoms or alkyl group having 1 to 18 carbon atoms, p is a number of from 2 to 5 and n is a number of from 1 to 50.

10 Claims, No Drawings

LUBRICANT COMPOSITIONS FOR SYNTHETIC FIBERS AND METHOD FOR LUBRICATING SYNTHETIC FIBERS

The present invention relates to a lubricating agent for synthetic fibers. More particularly, the invention relates to a lubricating agent for synthetic fibers which have to pass through a heating step.

In the manufacture of synthetic fibers, spun filaments formed by melt spinning are heated for stretching thereof, or they are thermally set to improve the properties thereof. Further, thermoplastic synthetic fibers which have passed through a false-twisting step are ordinarily heat-treated to set the shape and configuration thereof. Furthermore, synthetic fibers to be used for the manufacture of tire cord yarns are ordinarily stretched under severe heating conditions to obtain high tenacity yarns.

In these manufacturing steps, fibers or filaments are often treated at considerably high speeds, and therefore, lubricating compositions to be applied to fibers or filaments so as to advance such steps as spinning, stretching and processing smoothly, are required to have high heat resistance, high smoothness and high antistatic effect. For satisfying these requirements, as lubricants to be compounded with emulsifiers, antistatic agents and the like, there have heretofore been used mineral oils, esters of higher alcohols with fatty acids or dibasic acids such as adipic acid and sebacic acid, and esters of fatty acids with polyhydric alcohols such as trimethylol propane and glycerin.

These conventional lubricating agents have a good smoothness, but their heat resistance is insufficient when they are applied to synthetic fibers and filaments which have to pass through an especially severe heating step such as a heat stretching step or false twisting step, and fuming is readily caused and the working environment is contaminated. Furthermore, a tar-like substance is formed on the heater whereby to contaminate the yarn passage conspicuously, and mono-filament winding or yarn breakage takes place. As a result, stretching or false twisting cannot be performed smoothly, and it is necessary to stop the machine to remove such tar-like substance by cleaning. Thus, various troubles are caused and the operation efficiency is reduced.

As fiber oiling agents which do not form a tar-like substance on a heater and reduce the occurrence of fuming, there have heretofore been proposed an aromatic polybasic acid ester with a fatty acid (Japanese Patent Publication No. 16133/66), an ester of an aromatic polybasic acid with an alkylene oxide adduct of a higher alcohol (Japanese Patent Publication No. 17039/66 or Japanese Patent Application Laid-Open Specification No. 59516/75), and a polyoxyalkylene monobenzylphenol or polyoxyalkylene monostyrylphenol (Japanese Patent Application Laid-Open Specification No. 154525/75 or No. 4322/76). When we made experiments on these known compounds, it was found that the heat resistance of these compounds is improved over that of ordinary fatty acid esters free of an aromatic ring, but they still fail to satisfy a severe requirement of the heat resistance for oiling agents that are used under recently adopted severe processing conditions.

Furthermore, Japanese Patent Publication Unexamined No. 2625/1978 discloses a method for manufacturing polyester fiber which comprises, when it has been spun, attaching thereto an oily agent containing (1) 40 to 90% of propylene oxide and ethylene oxide copolymer having a mole ratio of propylene oxide to ethylene oxide of 50/50 or above, a molecular weight of 1500 or above and the terminal group of hydroxyl group or hydrocarbon group of 4 or less carbon atoms, and (2) 10 to 60% of an emulsifier of the formula:

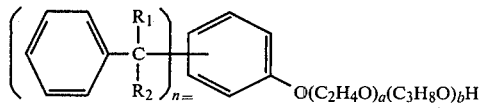

in which $R_1$ and $R_2$ each are hydrogen or hydrocarbon group having 4 or less carbon atoms; n is a number of larger than 1 and smaller than 3; and a and b each are an integer of zero or above, both a and b not being zero. It is noted that this method is always effected with two compounds (1) and (2).

We made researches with a view to preventing the occurrence of fuming or formation of a tar-like substance in the heating process, and as a result, we found that a treating agent comprising as an effective ingredient a compound represented by the following general formula [I]:

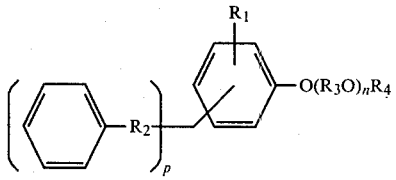

wherein $R_1$ stands for a hydrogen atom or a phenyl group, $R_2$ stands for an alkylene group having 1 to 3 carbon atoms, $R_3$ stands for an alkylene group having 2 to 4 carbon atoms or a mixed alkylene group thereof, $R_4$ stands for a hydrogen atom or an acyl or alkyl group having 1 to 18 carbon atoms, p is a number of from 2 to 5, and n is a number of from 1 to 50, does not substantially cause fuming or form a tar-like substance, and based on this finding, we have now completed the present invention.

The compound of the general formula [I] that is used in the present invention may be prepared according to a known process. For example, the compound of the general formula [I] is prepared by adding an alkylene oxide having 2 to 4 carbon atoms to tris-benzyl phenol or α-methylbenzyl phenol according to customary procedures or by esterifying the so formed product with a monocarboxylic acid having 1 to 18 carbon atoms or further reacting the so formed ester with an alkyl chloride having 1 to 18 carbon atoms in the alkyl portion.

In the compound of the general formula [I] that is used in the present invention, $R_1$ stands for a hydrogen atom or a phenyl group.

$R_2$ in the general formula [I] stands for an alkylene group having 1 to 3 carbon atoms. As specific examples of $R_2$, there can be mentioned methylene, ethylene and isopropylene groups.

In the general formula [I], $R_3$ stands for an alkylene group having 2 to 4 carbon atoms or a mixed alkylene group thereof. As specific examples of $R_3$, there can be mentioned ethylene, propylene and butylene groups, and a mixed alkylene group of ethylene and propylene groups. It is preferred that $R_3$ be an ethylene group.

In the general formula [I], $R_4$ is hydrogen atom, an acyl group having 1 to 18 carbon atoms or an alkyl group having 1 to 18 carbon atoms. As the acyl group, there can be mentioned, for example, residues of acetic acid, propionic acid, capric acid, lauric acid, oleic acid and hydroxystearic acid, and as the alkyl group, there can be mentioned, for example, methyl, ethyl, hexyl, octyl, lauryl and stearyl groups. An acyl group having 12 to 18 carbon atoms is preferred, and an octyl group is preferred as the alkyl group.

According to the invention, $R_4$ is preferred to be an acyl group having 1 to 18 carbon atoms or an alkyl group having 1 to 18 carbon atoms, in respect to the effect of smoothing and lubricating property.

In the general formula [I], p is a number of from 2 to 5. A compound where p is 1 cannot be used in the present invention because fuming is conspicuous under heating. A compound where p is larger than 5 is not commercially available.

In the general formula [I], n is a number of from 1 to 50, preferably from 3 to 27. When n exceeds 50, the objects of the present invention, that is, the objects of preventing occurrence of fuming and formation of a tar-like substance can hardly be attained.

As described hereinbefore, the lubricating agent for synthetic fibers according to the present invention has a high heat resistance and is excellent in that the occurrence of fuming or formation of a tar-like substance is substantially prevented. Another characteristic of the lubricating agent of the present invention is that the lubricating agent per se has an emulsifying property and a good emulsion can be formed by this lubricating agent alone without addition of a particular emulsifier.

Ordinarily, when an alkylene oxide group is introduced into a compound having heat resistance, the heat resistance is reduced. In contrast, in the compound of the present invention, even if the number (n) of moles of the alkylene oxide group to be added in the general formula [I] is increased to about 50, the heat resistance is hardly reduced. Accordingly, the mole number of the alkylene oxide group to be added can be appropriately increased according to the intended use, whereby a treating agent having an emulsifying property can be formed. Furthermore, when the compound of the general formula [I] is used in combination with an emulsifier, it is possible to increase the heat resistance by reducing the mole number of the alkylene oxide group to be added.

In addition to the compound of the general formula [I], the lubricating agent for synthetic fibers according to the present invention may further comprise a known lubricating agent (for example, an aliphatic monoester such as lauryl oleate or isotridecyl stearate, a dibasic acid ester such as dioleyl adipate or dioctyl phthalate, or a polyhydric alcohol ester such as trimethylolethane trilaurate, glycerin trioleate, polyoxyethylene bisphenol A dioleate and polyoxyethylene bisphenol A dilaurate), an emulsifier such as a polyoxyethylene sorbitan ester and an ethylene oxide adduct of hardened castor oil and an antistatic agent such as potassium alkyl phosphate, potassium oleate, an imidazoline type amphoteric activator or a betaine type amphoteric activator.

The lubricating method according to the invention may be, of course, effected with the compound of the formula (1), per se. But it may be attained also with the following composition containing the compound of the formula (1) as an effective component. The composition comprises from 10 to 90% of the compound of the formula (1), from 5 to 80% of a conventional lubricating agent, from 5 to 50% of an emulsifer, from zero to 20% of an antistatic agent and from zero to 5% of other additives such as an anti-oxidant. Preferred ranges of the respective ingredients are from 20 to 80%, from 10 to 70%, from 3 to 10%, from zero to 10%, and from zero to 5%.

The lubricating agent composition of the present invention can be emulsified in water according to customary procedures to form an aqueous emulsion or be dissolved in a diluent solvent having a low viscosity, and such emulsion or solution may be applied to fibers or filaments in an amount of 0.2 to 2.0% by weight according to an oiling roller method, a spray method or the like.

Synthetic fibers treated with the lubricating agent composition of the present invention have a very excellent heat resistance, and even if they are processed on a heater plate heated at 160° to 250° C., contamination of the working environment by fuming or reduction of the operation efficiency by formation of a tar-like substance on the heater is not caused at all.

The effects of the present invention will now be described by reference to the following Examples.

EXAMPLE 1

Structures of compounds A, B, C, D and E of the present invention and compounds F, G and H having an analogous structure but which are not included in the present invention are shown in Table 1, and the results of the heat resistance tests made on the compounds shown in Table 1 and known lubricating agents are shown in Table 2.

TABLE 1

| Compound | Structure | Remarks |
|---|---|---|
| A | 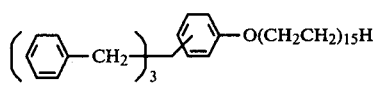 | Present invention |
| B | 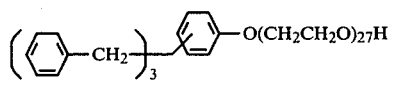 | Present invention |
| C | 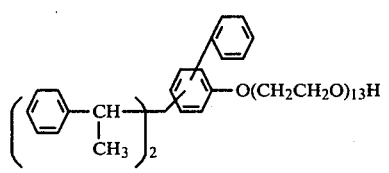 | Present invention |
| D | 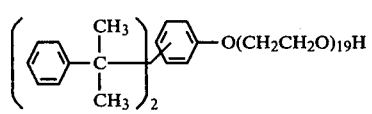 | Present invention |
| E | 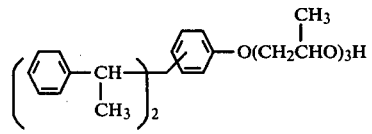 | Present invention |
| F | 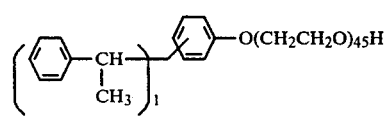 | outside present invention |

TABLE 1-continued

| Compound | Structure | Remarks |
|---|---|---|
| G | 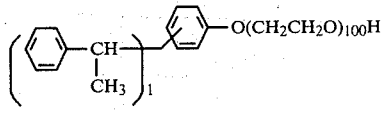 | outside present invention |
| H | 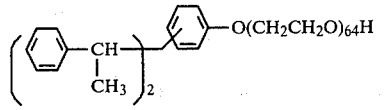 | outside present invention |

TABLE 2

| Compound | | Heat Resistance: Fuming Amount | Heat Resistance: Tar Forming Ratio (%) |
|---|---|---|---|
| Present Invention | A | 26.6 | 0.4 |
| | B | 40.2 | 0.8 |
| | C | 52.5 | 0.2 |
| | D | 51.0 | 0.2 |
| | E | 99.0 | 0.1 |
| Comparison | F | 159.5 | 15.8 |
| | G | 206.0 | 17.1 |
| | H | 172.5 | 13.0 |
| trioleyl trimellitate | | 142.1 | 33.6 |
| diglycerine dilaurate | | 199.8 | 28.8 |
| 1,6-hexanediol dioleate | | 162.8 | 42.4 |

The fuming amount and tar forming ratio were determined according to the following methods. In each of them, a smaller value indicates a better heat resistance.

Fuming Amount

In a metallic vessel, 0.1 g of a sample was charged and heated at 250° C. Smokes formed were introduced into a spectrometer and the extinction ratio during 5 minutes was integrated, and the obtained value was designated as the fuming amount. When no smoke is generated, the extinction ratio is zero.

Tar Forming Ratio

In a commercially available aluminum dish, about 0.5 g of a sample was collected, and the dish was placed in a hot air type drier and heated at 250° C. for 4 hours. The heated sample was naturally cooled to room temperature and the aluminum dish was washed with acetone. A residue not dissolved in acetone is ordinarily a black resinous substance, and as the amount of this residue is large, the tar forming ratio is high. Accordingly, the tar forming ratio was calculated according to the following formula:

$$\text{Tar forming ratio (\%)} = \frac{\text{weight (g) of acetone-insoluble residue}}{\text{weight (g) of collected sample}} \times 100$$

EXAMPLE 2

Structures of compounds I, J, K, L and M of the present invention and compounds N and O having an analogous structure but being outside the scope of the present invention are shown in Table 3, and results of the heat resistance tests made on the compounds shown in Table 3 and known lubricating agents are shown in Table 4. It will readily be understood that the compounds of the present invention are very excellent in the thermal stability, and do not cause contamination of the working environment by fuming or reduction of the operation efficiency by forming of a tar-like substance.

TABLE 3

| Compound | Structure | | Remarks |
|---|---|---|---|
| I | 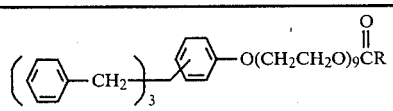 | (R = $C_{11}H_{23}$) | present invention |
| J | 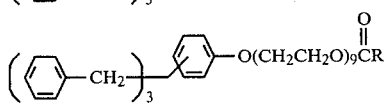 | (R = $C_{17}H_{35}$) | " |
| K | 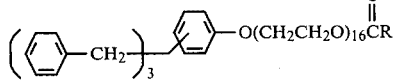 | (R = $C_{11}H_{23}$) | " |
| L | 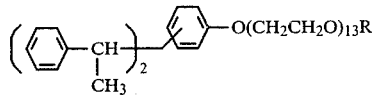 | (R = $C_8H_{17}$) | " |
| M | 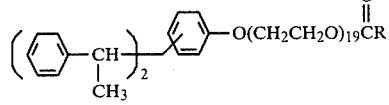 | (R = $C_{11}H_{23}$) | " |
| N | 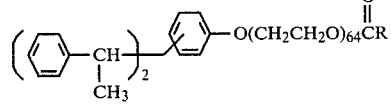 | (R = $C_{11}H_{23}$) | outside present invention |
| O | 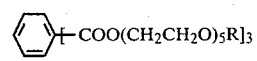 | (R = $C_{11}H_{23}$) | outside present invention |

TABLE 4

| Compound | | Heat Resistance: Fuming Amount | Heat Resistance: Tar Forming Ratio (%) |
|---|---|---|---|
| Present Invention | I | 19.0 | 0.0 |
| | J | 19.4 | 0.0 |
| | K | 52.9 | 0.6 |
| | L | 53.4 | 2.4 |
| | M | 55.6 | 1.8 |
| Comparison | N | 165.0 | 10.0 |
| | O | 138.1 | 17.5 |
| oleyl oleate | | 242.5 | 43.5 |
| dioleyl adipate | | 189.5 | 41.4 |
| diglycerine dioleate | | 139.8 | 70.2 |
| distearyl alcohol ester of dimer acid having 21 carbon atoms | | 114.5 | 46.5 |

The fuming amount and tar forming ratio were determined according to the methods described in Example 1.

From the results of Examples 1 and 2, it will readily be understood that the compounds A, B, C, D, E, I, J, K, L and M of the present invention have a very excellent heat resistance but compounds represented by the general formula [I] but outside the scope of the present invention, for example, compounds where n is larger than 50 (compounds G, H and N) or compounds where p is less than 2 (compound F) are insufficient in the heat resistance.

EXAMPLE 3

Three compounds according to the invention were examined with respect to the heat resistance and smoothness. As to the heat resistance, fuming amount and tar forming ratio were checked in the same manner as in Example 1. The smoothness test was conducted in the following way. Each of compounds listed in Table 5 was attached to polyester filament fibers (250 denier) which were available in the commercial market, in an amount of about one percent by weight based on the weight of the fibers. Each sample of the fibers was examined with respect to the secondary tension. In the measurement, Micro Meter (trademark, manufactured by Eikoh Sokki K.K.) was used under conditions where the initial tension was 15 grams; the contact angle between the fiber filament and the friction pin was 180°; and the speed of the filament was that listed in Table 6. The smaller the secondary tension measured, the better the smoothness of each compound. Results are shown in Table 6.

TABLE 5

| Compound | Chemical Structure |
|---|---|
| P | 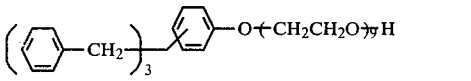 |
| Q | 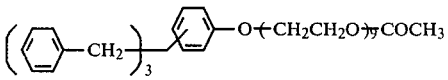 |
| I | 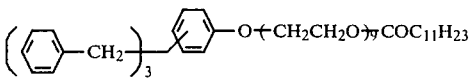 |

TABLE 6

| Compound | fuming amount | tar forming ratio (%) | smoothness (g) 140 (m/min) | 260 | 500 |
|---|---|---|---|---|---|
| P | 6.1 | 1.4 | 165 | 164 | 158 |
| Q | 7.5 | 0.5 | 141 | 149 | 153 |
| I | 19.0 | 0.0 | 139 | 141 | 150 |

It is understood from the above shown results that all compounds are improved in the heat resistance and two compounds having an acyl group for $R_4$ are improved especially with respect to the smoothness.

The embodiments of the invention of which an exclusive property or privilege is claimed are defined as follows:

1. A method for lubricating synthetic fibers which comprises treating the synthetic fibers with a composition comprising a compound of the formula:

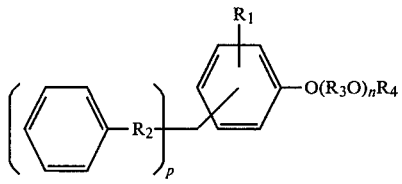

wherein $R_1$ is hydrogen or phenyl group, $R_2$ is an alkylene group having 1 to 3 carbon atoms, $R_3$ is an alkylene group having 2 to 4 carbon atoms or a mixed alkylene group thereof, $R_4$ is hydrogen, an acyl having 1 to 18 carbon atoms or an alkyl group having 1 to 18 carbon atoms, p is a number of from 2 to 5, and n is a number of from 1 to 50.

2. A method as claimed in claim 1, wherein $R_3$ is ethylene.

3. A method claimed in claim 1, wherein $R_4$ is an acyl group having 12 to 18 carbon atoms or octyl group.

4. A method claimed in claim 1, wherein n is a number of from 3 to 27.

5. A method as claimed in claim 1, wherein $R_4$ is an alkyl having 1 to 18 carbon atoms.

6. A method as claimed in claim 1, wherein $R_4$ is an acyl group having 1 to 18 carbon atoms.

7. A method as claimed in claim 1, wherein said synthetic fibers are treated with an aqueous emulsion of said compound or a solution of said compound in a low-viscosity solvent, in an amount of 0.2 to 2.0 percent by weight of said fibers.

8. A method as claimed in claim 1, which comprises treating the synthetic fibers with an aqueous emulsion or a solvent solution of a composition comprising from 10 to 90% of said compound, from 5 to 80% of fiber lubricating agent selected from the group consisting of lauryl oleate, isotridecyl stearate, dioleyl adipate, dioctyl phthalate, trimethylolethane trilaurate, glycerin trioleate, polyoxyethylene 2,2-bis(4-hydroxyphenyl)propane dioleate and polyoxyethylene 2,2-bis(4-hydroxyphenyl)propane dilaurate, from 5 to 50% of emulsifier selected from the group consisting of polyoxyethylene sorbitan ester and ethylene oxide adduct of hardened caster oil and from zero to 20% of an antistatic agent selected from the group consisting of potassium alkyl phosphate, potassium oleate, imidazoline amphoteric surfactant and betaine amphoteric surfactant.

9. A synthetic fiber-lubricating composition consisting essentially of an aqueous emulsion or a solvent solution of a composition comprising from 10 to 90% of a compound of the formula:

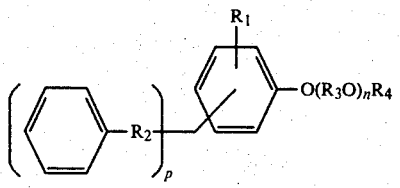

wherein $R_1$ is hydrogen or phenyl group, $R_2$ is an alkylene group having 1 to 3 carbon atoms, $R_3$ is an alkylene group having 2 to 4 carbon atoms or a mixed alkylene group thereof, $R_4$ is hydrogen, an acyl having 1 to 18 carbon atoms or an alkyl group having 1 to 18 carbon atoms, p is a number of from 2 to 5, and n is a number of from 1 to 50, from 5 to 80% of fiber lubricating agent selected from the group consisting of lauryl oleate, isotridecyl stearate, dioleyl adipate, dioctyl phthalate, trimethylolethane trilaurate, glycerin trioleate, polyoxyethylene 2,2-bis-(4-hydroxyphenyl)propane dioleate and polyoxyethylene 2,2-bis(4-hydroxylphenyl)propane dilaurate, from 5 to 50% of emulsifier selected from the group consisting of polyoxyethylene sorbitan ester and ethylene oxide adduct of hardened castor oil and from zero to 20% of an antistatic agent selected from the group consisting of potassium alkyl phosphate, potassium oleate, imidazoline amphoteric surfactant and betaine amphoteric surfactant.

10. A synthetic fiber-lubricating composition as claimed in claim 9, wherein $R_4$ of said compound is an acyl having 1 to 18 carbon atoms or an alkyl having 1 to 18 carbon atoms.

* * * * *